United States Patent [19]

Matsuda et al.

[11] Patent Number: 4,838,044

[45] Date of Patent: Jun. 13, 1989

[54] WARP-KNIT TAPE FOR HOOK-AND-LOOP FASTENERS

[75] Inventors: Yoshio Matsuda, Toyama; Mitsutoshi Ishihara, Kurobe, both of Japan

[73] Assignee: Yoshida Kogyo K. K., Tokyo, Japan

[21] Appl. No.: 172,270

[22] Filed: Mar. 22, 1988

[30] Foreign Application Priority Data

Mar. 24, 1987 [JP] Japan ..... 62-43183

[51] Int. Cl.[4] ..... D04B 7/12

[52] U.S. Cl. ..... 66/190; 66/192; 66/194

[58] Field of Search ..... 66/194, 190, 191, 192, 66/195

[56] References Cited

U.S. PATENT DOCUMENTS

| | | | |
|---|---|---|---|
| 2,957,327 | 10/1960 | Glover | 66/191 |
| 2,968,085 | 1/1961 | Matthews | 66/191 |
| 2,989,858 | 6/1961 | MacCaffray | 66/191 X |
| 3,109,302 | 11/1963 | Vitek | 66/191 X |
| 3,255,615 | 6/1966 | Schwartz | 66/195 |
| 3,603,117 | 9/1971 | Suoboda | 66/193 |
| 4,709,562 | 12/1987 | Matsuda | 66/193 |

FOREIGN PATENT DOCUMENTS

| | | | |
|---|---|---|---|
| 1189336 | 6/1985 | Canada | 66/194 |
| 0091273 | 12/1983 | European Pat. Off. . | |
| 1539997 | 8/1968 | France . | |
| 2070334 | 9/1971 | France . | |
| 566117 | 9/1975 | Switzerland . | |

*Primary Examiner*—Ronalds Feldbaum

*Attorney, Agent, or Firm*—Hill, Van Santen, Steadman & Simpson

[57] ABSTRACT

A warp-knit tape is disclosed for use in hook-and-loop fasteners, which tape comprises a pile portion and selvage portions on opposite sides thereof, the pile portion including pile-loops arranged to extend longitudinally in a meandering fashion to prevent the same from tilting down flat on the surface of the tape.

3 Claims, 3 Drawing Sheets

WARP-KNIT TAPE FOR HOOK-AND-LOOP FASTENERS

BACKGROUND OF THE INVENTION

1. Field of the Invention

This invention relates to a hook-and-loop fastener otherwise known as a surface fastener comprising two layers of fabric which are releasably engageable with each other. One of the fabric layers carries hook-shaped or male elements engageable with loop or female elements on the other fabric layer. The present invention is more specifically concerned with a warp-knit support tape for such hook-and-loop fasteners carrying thereon a multiplicity of pile-loop elements and engageable with a mating hook-carrying tape.

2. Description of the Related Art

There have been proposed many different forms of hook-and-loop fastener tapes, one such tape being disclosed in Japanese Utility Model Application No. 60-162742 (corresponding to U. S. Pat. No. 4,709,567 issued Dec. 1, 1987) to which the present invention is interrelated. The disclosed hook-and-loop fastener tape, as shown in FIG. 4 of the accompanying drawings, comprises a foundation web consisting two-needle stitches and laid-in weft threads, and a multiplicity of pile loops, in which the sinker loops of the two needle stitches are arranged to urge and hold the leg portions of the pile loops criss-cross against the foundation web, while the laid-in weft threads fill up in between the sinker loops and the pile loops, thus anchoring the pile loops stably in place against displacement or dislocation. The sinker loops of the two-needle stitches and the laid-in weft threads are further arranged to bear against the foundation loops which form the wales, so that the fastener tape as a whole is rendered highly resistant to stretch in either direction.

While the above-mentioned prior art device is satisfactory in its resistance to displacement or dislocation of the piles, it has been found somewhat defective in the ability of engaging with hook elements on the mating counterpart on account of the fact that the pile loops alternating on the right and the left side of the wales are prone to tilt down flat on the tape surface in opposite directions.

SUMMARY OF THE INVENTION

It is therefore the primary object of the present invention to provide a warp-knit female tape for a hook-and-loop fastener which will eliminate the foregoing drawbacks, of the prior art and which is highly resistant to pile displacement or dislocation and free from pile tilting so as to ensure a maximum of opportunity of engagement with a mating male tape.

A warp-knit tape for hook-and-loop fasteners includes a pile portion and selvage portions on opposite sides thereof, the pile portion including pile-loops arranged to extend longitudinally in a zig-zag or meandering fashion to prevent the same from tilting down flat on the surface of the tape.

The above object and other features of the invention will be better understood from the following detailed description taken with reference to the accompanying drawings, in which like reference numerals refer to like or corresponding parts throughout the several views.

DETAILED DESCRIPTION OF THE INVENTION

Figure 1:
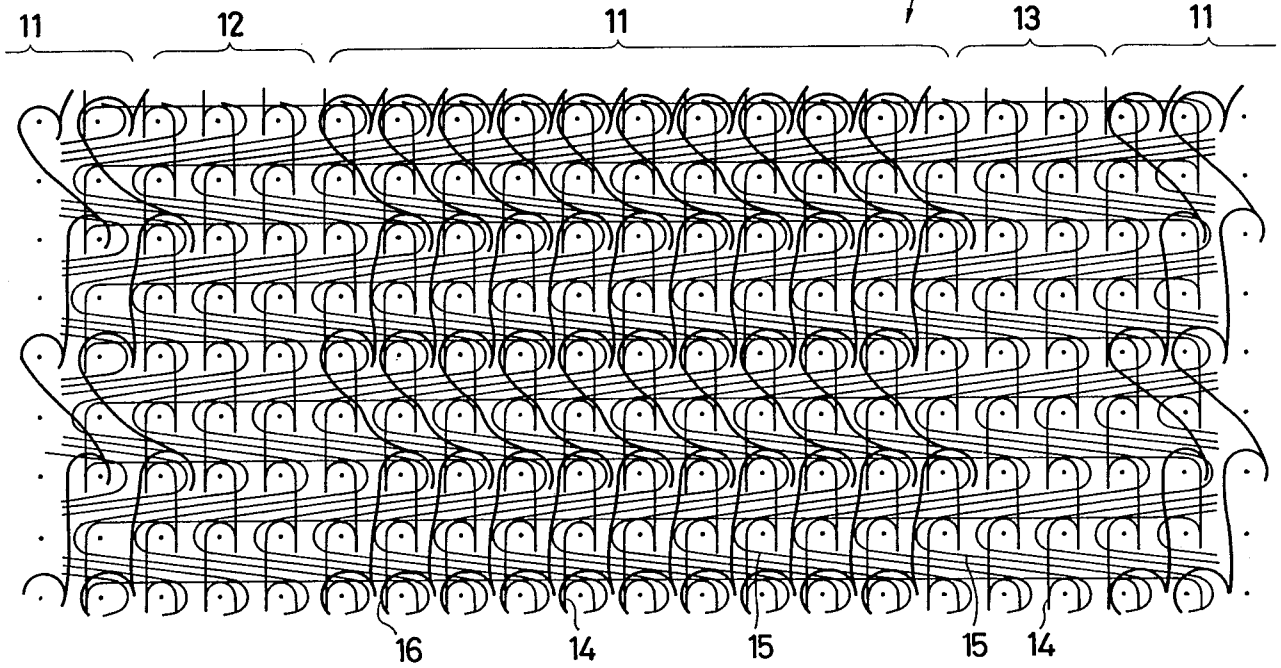
FIG. 1 schematically illustrates the construction of a warp-knit tape embodying the invention for use as a loop or female part of a hook-and-loop fastener.
Figure 2A:
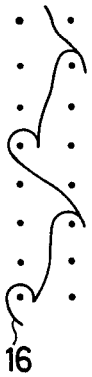
FIG. 2*a*–2*d*, inclusive, each are schematic representations of the constituent stitches for the tape of FIG. 1.
Figure 3:
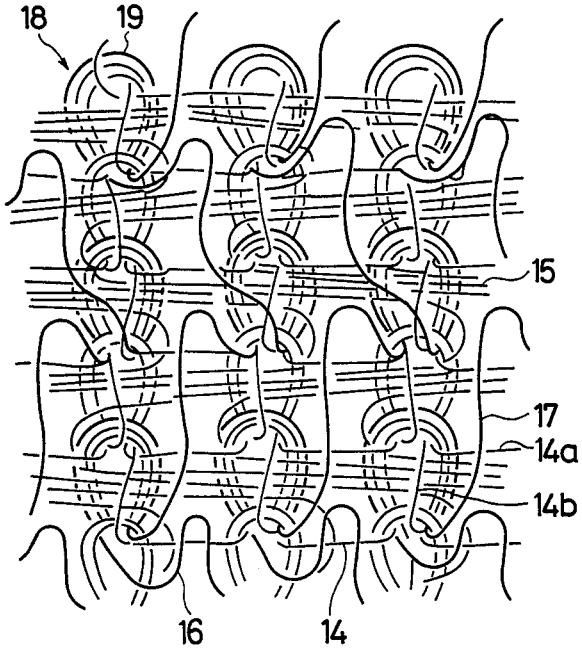
FIG. 3 is a schematic diagram on enlarged scale of a portion of the tape of FIG. 1.

Referring now to the drawings and FIG. 1 in particular, there is shown a preferred form of warp-knit support tape 10 to be used as a loop or female part of a hook-and-loop fastener. The support tape 10 consists of a pile portion 11 and selvage portions 12 and 13 extending warpwise on opposite sides of the pile portion 11. The pile portion 11 of the tape 10 is constructed with two needle stitches 14, laid-in weft threads 15, both of which are laced together to make up a foundation of the tape 10, and pile-forming threads 16 of a multifilament which form a multiplicity of pile-loops 17 (FIG. 3). As shown in FIG. 2*a*, the pile-forming stitch 16 is represented by Link No. 2-1/1-1/1-0/1-1, and threads therefor are positively overfed beyond the normal rate of feed of threads for the remaining stitches and formed by sinker looping into pile-loops 17 (FIG. 3) extending over every other course in overlapping relation to the knitting needles.

Figure 4:
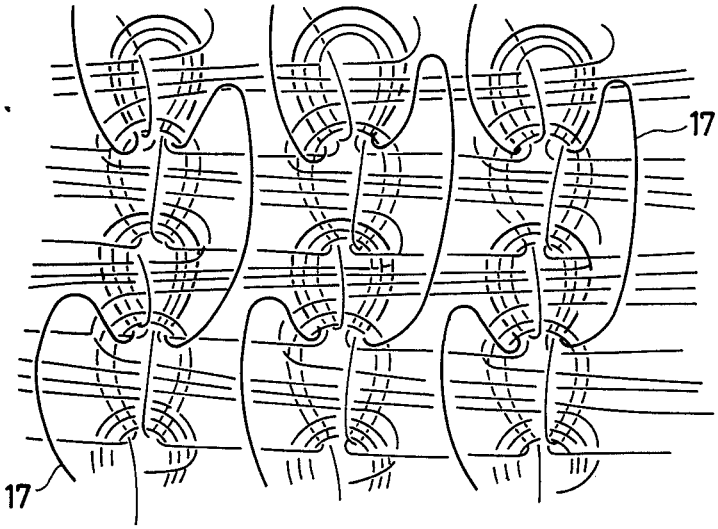
FIG. 4 RELATED ART
FIG. 4 is a view similar to FIG. 3 but showing a related art counterpart.

The pile-loops 17 are arranged, as shown in FIG. 3, to extend longitudinally in a zig-zag or meandering fashion such that they may be free from tilting as in the case of the related art shown in FIG. 4, the arrangement being that the pile-loops 17 give themselves more opportunity to engage the hooks on the mating tape, not shown, regardless of the orientation of the latter.

Figure 2B:
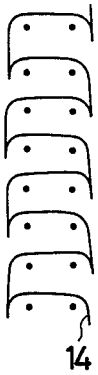
Figure 2C:
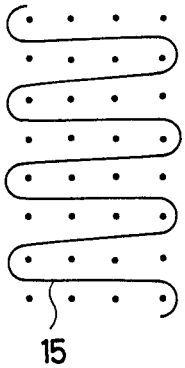
Figure 2D:
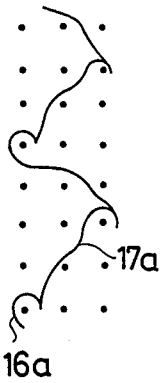

A modified form of pile-loop 17*a* is shown in FIG. 2*d* which is represented by stitch Link No. 3-2/2-2/2-1/2-2 formed by threads 16*a* lapping on every other adjacent needles over every other course. The height of the pile-loops 17, (17*a*) may be adjusted by the number of needles to be skipped in the weft-wise direction and the number of courses to be skipped in the warp-wise direction.

The foundation of the support tape 10 is formed by two needle stitches 14 of Link No. 0-2/2-0 as shown in FIG. 2*b* and laid-in weft threads 15 of Link No. 0-0/4-4. As shown in FIG. 3, the sinker loops 14*a*, 14*b* of two needle stitches 14 are arranged to urge and hold the leg portions of pile-loops 17 criss-cross against the foundation web of the tape 10, while the laid-in weft threads 15 fill up in between the sinker loops 14*a*, 14*b* and the pile-loops 17, thus anchoring the pile-loops 17 stably in place against displacement or dislocation.

As better shown in FIG. 3, the sinker loops 14*a*, 14*b* of two needle stitches 14 are laced in a manner to bear against the foundation loops 19 that form the wales 18, and the weft threads 15 that are laid in densely between the foundation loops 19 and the sinker loops 14, 14*b* are held in place by the latter loops, whereby the tape system as a whole is rendered highly resistant to stretch in either direction. This will in turn serve to reduce the amount of resinous coatings required to make the knit tape firm and prevent the pile-loops from falling off and further to provide a tape product which is physically soft.

The selvages 12 and 13 interconnect a plurality of pile portions 11 in parallel and can be cut to provide individual tape lengths conveniently on use, and are constructed only with the two needle stitches 14 and laid-in weft threads 15 to provide relatively wide wale-grooves so as to facilitate sewing of the tape 10 onto a garment article.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A warp-knit tape for hook-and-loop fasteners which comprises a pile portion and selvage portions extending on opposite sides of said pile portion, said pile portion being formed with two needle stitches forming a plurality of wales extending longitudinally of said tape, laid-in weft thread interlaced with said two needle stitches to make up a foundation structure of said tape, and a pile-forming thread knitted in said foundation structure and forming pile-loops extending longitudinally in a meandering fashion between at least two adjacent wales of said tape.

2. A warp-knit tape for hook-and-loop fasteners according to claim 1 wherein said pile-loops are formed by threads of a stitch represented by Link No. 2-1/1-1/1-0/1-1.

3. A warp-knit tape for hook-and-loop fasteners according to claim 1 wherein said pile-loops are formed by threads of a stitch represented by Link No. 3-2/2-2/2-1/2-2.

* * * * *